US006187261B1

(12) United States Patent
Fedchun

(10) Patent No.: US 6,187,261 B1
(45) Date of Patent: Feb. 13, 2001

(54) SI(GE)(-) CU(-)V UNIVERSAL ALLOY STEEL

(75) Inventor: Vladimir A. Fedchun, Moscow (RU)

(73) Assignee: Modern Alloy Company L.L.C., Southfield, MI (US)

( * ) Notice: Under 35 U.S.C. 154(b), the term of this patent shall be extended for 0 days.

(21) Appl. No.: 09/003,923

(22) Filed: Jan. 7, 1998

Related U.S. Application Data

(63) Continuation-in-part of application No. PCT/RU96/00184, filed on Jul. 9, 1996, and a continuation-in-part of application No. PCT/RU96/00230, filed on Aug. 15, 1996.

(51) Int. Cl.[7] ..... C22C 38/00
(52) U.S. Cl. ..... 420/8; 420/90; 420/104
(58) Field of Search ..... 420/8, 90–91, 420/104, 49, 55, 58, 60, 112, 119

(56) References Cited

U.S. PATENT DOCUMENTS 3,853,544 * 12/1974 Nishi et al. .
3,954,421 * 5/1976 Heuschkel .
3,955,971 * 5/1976 Reisdorf .
4,157,258 6/1979 Philip et al. .
4,642,219 * 2/1987 Takata et al. .
4,650,645 3/1987 Kato et al. .
4,740,353 * 4/1988 Cogan et al. ..... 420/49
5,055,253 10/1991 Nelson .
5,616,187 4/1997 Nelson .
5,639,421 6/1997 Ichikawa et al. .

FOREIGN PATENT DOCUMENTS 1675379 5/1991 (RU) .

* cited by examiner

*Primary Examiner*—Ngoclan Mai
(74) *Attorney, Agent, or Firm*—Roder, Fishman & Grauer PLLC

(57) ABSTRACT

A composition and method for reducing cost and improving the mechanical properties of alloy steels. The invention resides in the ability of certain combinations of carbon-subgroup surfactants and d-transition metals to modify and control diffusion mechanisms of interstitial elements; to reduce or prevent the formation of non-equilibrium segregations of harmful admixtures and brittle phases on free metal surfaces and grain and phase boundaries; and to alter and control phase transformation kinetics in steel during heating and cooling.

2 Claims, 13 Drawing Sheets

Classification of Universal Steels

| Type | Class | Classification | Alloying System | Figure | | |
|---|---|---|---|---|---|---|
| General Engineering Steels | I | High Ductility Steel | 10CrABC | 2 | | |
| | II | Case Hardening Steel | 25CrABC | 3 | | |
| | III | Direct Hardening, Nitriding Steel | 40CrABC | 4 | 5 | 6 |
| | IV | Direct Hardening, Nitriding Steel | 50CrABC | 7 | | |
| | V | Tool Steel | 60CrABC | 8 | | |
| | VI | Maraging Steel | 10Cr10Ni8ABC | 13 | | |
| Stainless Steels | VII | High Ductility Steel | 10Cr16ABC | 9 | | |
| | VIII | Direct Hardening Steel | 40Cr16ABC | 10 | 11 | |
| | IX | Tool Steel | 60Cr16ABC | 12 | | |

Figure 1

General Engineering Universal Steel
High Ductility Steel

| Alloying System | (Si+Cu)/V | Chemical Composition, wt. % | | | | | | | |
|---|---|---|---|---|---|---|---|---|---|
| | | C | Mn | Si | Cr | Cu | V | S | P |
| | 8.23 | 0.10 | 0.47 | 0.84 | 0.62 | 0.56 | 0.17 | 0.025 | 0.021 |

| Si - Cu - V | Heat Treatment | Static and Dynamic Characteristics | | | | | | | | |
|---|---|---|---|---|---|---|---|---|---|---|
| | | Brinell Hardness | Tensile Min. Strength, N/sq. mm | Est. Yield Min. Strength, N/sq. mm | Elongation, % | Reduction Area, % | Impact Value, J/sq. cm | | | |
| | | | | | | | KCU | KCV | KCU | KCV |
| | Due to Mill Rolling Only | 260 | 680 | 490 | 24 | 70 | + 20°C | | - 60°C | |
| | | | | | | | 200 | 182 | 180 | 160 |

| Alloying System | (Ge+Cu)/V | Chemical Composition, wt. % | | | | | | | | |
|---|---|---|---|---|---|---|---|---|---|---|
| | | C | Mn | Si | Cr | Ge | Cu | V | S | P |
| | 6.72 | 0.12 | 0.51 | 0.17 | 0.57 | 0.74 | 0.47 | 0.18 | 0.025 | 0.021 |

| Ge - Cu -V | Heat Treatment | Static and Dynamic Characteristics | | | | | | | | |
|---|---|---|---|---|---|---|---|---|---|---|
| | | Brinell Hardness | Tensile Min. Strength, N/sq. mm | Est. Yield Min. Strength, N/sq. mm | Elongation, % | Reduction Area, % | Impact Value, J/sq. cm | | | |
| | | | | | | | KCU | KCV | KCU | KCV |
| | Due to Mill Rolling Only | 245 | 650 | 570 | 26 | 76 | + 20°C | | - 60°C | |
| | | | | | | | 220 | 200 | 190 | 174 |

Figure 2

General Engineering Universal Steel
Case Hardening Steel

| Alloying System | (Si+Cu)/V | Chemical Composition, wt. % | | | | | | | |
|---|---|---|---|---|---|---|---|---|---|
| | | C | Mn | Si | Cr | Cu | V | S | P |
| | 6.81 | 0.27 | 0.38 | 0.92 | 0.74 | 0.58 | 0.22 | 0.019 | 0.02 |

| Si - Cu - V | Heat Treatment | Static and Dynamic Characteristics | | | | | | | | |
|---|---|---|---|---|---|---|---|---|---|---|
| | | Rockwell Hardness | Tensile Min. Strength, N/sq. mm | Est. Yield Min. Strength, N/sq. mm | Elongation, % | Reduction Area, % | Impact Value, J/sq. cm | | | |
| | | | | | | | KCU | KCV | KCU | KCV |
| | Quench., Low Temper. | C38 | 1256 | 998 | 15 | 49 | + 20°C | | - 40°C | |
| | | | | | | | 68 | 43 | 29 | 22 |
| | Carburizing, Quench., Low Temper. | C56 | 1690 | 1615 | 8.1 | 26.4 | 24 | 16 | 12.2 | 9.8 |

| Alloying System | (Ge+Cu)/V | Chemical Composition, wt. % | | | | | | | | |
|---|---|---|---|---|---|---|---|---|---|---|
| | | C | Mn | Si | Cr | Ge | Cu | V | S | P |
| | 6.34 | 0.25 | 0.42 | 0.18 | 0.64 | 0.92 | 0.54 | 0.23 | 0.02 | 0.02 |

| Ge - Cu -V | Heat Treatment | Static and Dynamic Characteristics | | | | | | | | |
|---|---|---|---|---|---|---|---|---|---|---|
| | | Rockwell Hardness | Tensile Min. Strength, N/sq. mm | Est. Yield Min. Strength, N/sq. mm | Elongation, % | Reduction Area, % | Impact Value, J/sq. cm | | | |
| | | | | | | | KCU | KCV | KCU | KCV |
| | Quench., Low Temper. | C36 | 1220 | 1150 | 17 | 51 | + 20°C | | - 40°C | |
| | | | | | | | 74 | 51 | 32 | 25 |
| | Carburizing, Quench., Low Temper. | C56 | 1720 | 1670 | 10.4 | 32 | 36 | 21 | 16.2 | 11.6 |

Figure 3

General Engineering Universal Steel
Direct Hardening, Nitriding Steel

| Alloying System | (Si+Cu)/V | Chemical Composition, wt. % | | | | | | | |
|---|---|---|---|---|---|---|---|---|---|
| | | C | Mn | Si | Cr | Cu | V | S | P |
| | 6.08 | 0.39 | 0.27 | 0.87 | 1.99 | 0.59 | 0.24 | 0.021 | 0.019 |

| Alloying System | Heat Treatment | Static and Dynamic Characteristics | | | | | | | | |
|---|---|---|---|---|---|---|---|---|---|---|
| | | Rockwell Hardness | Tensile Min. Strength, N/sq. mm | Est. Yield Min. Strength, N/sq. mm | Elongation, % | Reduction Area, % | Impact Value, J/sq. cm | | | |
| | | | | | | | KCU | KCV | KCU | KCV |
| | | | | | | | + 20°C | | - 40°C | |
| Si - Cu - V | Quenching at 890°C Low Temper. at 200°C | C55 | 2010 | 1890 | 10 | 42 | 64 | 42 | 36 | 28 |
| | Quenching at 890°C Mid. Temper. at 500°C | C46 | 1510 | 1470 | 13 | 45 | 59 | 40 | 34 | 23 |
| | Quenching at 890°C High Temper. at 650°C | C28 | 910 | 874 | 23 | 65 | 120 | 94 | 76 | 67 |

Figure 4

General Engineering Universal Steel
Direct Hardening, Nitriding Steel

| Alloying System | (Ge+Cu)/V | Chemical Composition, wt. % | | | | | | | | |
|---|---|---|---|---|---|---|---|---|---|---|
| | | C | Mn | Si | Cr | Ge | Cu | V | S | P |
| | 9.35 | 0.41 | 0.44 | 0.18 | 1.87 | 0.97 | 0.62 | 0.17 | 0.019 | 0.021 |

| Ge - Cu -V | Heat Treatment | Static and Dynamic Characteristics | | | | | | | | |
|---|---|---|---|---|---|---|---|---|---|---|
| | | Rockwell Hardness | Tensile Min. Strength, N/sq. mm | Est. Yield Min. Strength, N/sq. mm | Elongation, % | Reduction Area, % | Impact Value, J/sq. cm | | | |
| | | | | | | | KCU | KCV | KCU | KCV |
| | | | | | | | + 20°C | | - 40°C | |
| | Quenching at 890°C Low Temper. at 200°C | C56 | 2180 | 1970 | 12 | 48 | 78 | 59 | 47 | 42 |
| | Quenching at 890°C Mid. Temper. at 500°C | C47 | 1615 | 1590 | 14 | 52 | 74 | 58 | 55 | 46 |
| | Quenching at 890°C High Temper. at 650°C | C29 | 1050 | 990 | 25 | 68 | 180 | 120 | 98 | 84 |

Figure 5

General Engineering Universal Steel
Direct Hardening Steel, Nitriding Steel

| Alloying System | (Si+Cu)/V | Chemical Composition, wt. % | | | | | | | |
|---|---|---|---|---|---|---|---|---|---|
| | | C | Mn | Si | Cr | Cu | V | S | P |
| | 6.08 | 0.39 | 0.27 | 0.87 | 1.99 | 0.59 | 0.24 | 0.021 | 0.019 |
| Si - Cu - V | Heat Treatment | Service Operations Characteristics | | | | | | | |
| | | Core Hardness, Rockwell | Nitrided Layer Surf. Hardness HV, N/sq. mm | Nitrided Layer Depth, mm | Impact Value, KCU, J/sq. cm | Ultimate Contact Endurance, N/sq. mm | Ultimate Fatigue Strength, N/sq. mm | Relative Wear Resistance * | |
| | Ion Nitriding 500°C, 24 hrs. | C45 | 8400 | 0.64 | 52 | 2200 | 620 | 1.24 | |

| Alloying System | (Ge+Cu)/V | Chemical Composition, wt. % | | | | | | | | |
|---|---|---|---|---|---|---|---|---|---|---|
| | | C | Mn | Si | Cr | Ge | Cu | V | S | P |
| | 9.35 | 0.41 | 0.44 | 0.18 | 1.87 | 0.97 | 0.62 | 0.17 | 0.019 | 0.021 |
| Ge - Cu -V | Heat Treatment | Static and Dynamic Characteristics | | | | | | | | |
| | | Core Hardness, Rockwell | Nitrided Layer Surf.Hardness HV, N/sq. mm | Nitrided Layer Depth, mm | Impact Value, KCU, J/sq. cm | Ultimate Contact Endurance, N/sq. mm | Ultimate Fatigue Strength, N/sq. mm | Relative Wear Resistance * | | |
| | Ion Nitriding 500°C, 24 hrs. | C42 | 7900 | 0.78 | 65 | 2350 | 740 | 1.42 | | |

* wear resistance of bearing steel MX15Cr, heat treated to HRC 62 is assumed to be equal to 1.

Figure 6

General Engineering Universal Steel
Direct Hardening, Nitriding Steel

| Alloying System | (Si+Cu)/V | Chemical Composition, wt. % | | | | | | | |
|---|---|---|---|---|---|---|---|---|---|
| | | C | Mn | Si | Cr | Cu | V | S | P |
| | 6.66 | 0.54 | 0.78 | 1.02 | 0.86 | 0.58 | 0.24 | 0.021 | 0.02 |

| Si - Cu - V | Heat Treatment | Static and Dynamic Characteristics | | | | | | | | |
|---|---|---|---|---|---|---|---|---|---|---|
| | | Rockwell Hardness | Tensile Min. Strength, N/sq. mm | Est. Yield Min. Strength, N/sq. mm | Elongation, % | Reduction Area, % | Impact Value, J/sq. cm | | | |
| | | | | | | | KCU | KCV | KCU | KCV |
| | Quenching at 890°C Low Temper. at 180°C | C56 | 2310 | 1990 | 8 | 27 | + 20°C | | - 60°C | |
| | | | | | | | 36 | 23 | 21 | 16 |
| | Quenching at 890°C Mid.Temper. at 380°C | C52 | 1920 | 1895 | 8.5 | 29 | 34 | 21 | 19 | 14 |

| Alloying System | (Ge+Cu)/V | Chemical Composition, wt. % | | | | | | | | |
|---|---|---|---|---|---|---|---|---|---|---|
| | | C | Mn | Si | Cr | Ge | Cu | V | S | P |
| | 6.4 | 0.49 | 0.67 | 0.18 | 0.72 | 1.02 | 0.58 | 0.25 | 0.02 | 0.018 |

| Ge - Cu -V | Heat Treatment | Static and Dynamic Characteristics | | | | | | | | |
|---|---|---|---|---|---|---|---|---|---|---|
| | | Rockwell Hardness | Tensile Min. Strength, N/sq. mm | Est. Yield Min. Strength, N/sq. mm | Elongation, % | Reduction Area, % | Impact Value, J/sq. cm | | | |
| | | | | | | | KCU | KCV | KCU | KCV |
| | Quenching at 890°C Low Temper. at 180°C | C54 | 2230 | 2190 | 12 | 35 | + 20°C | | - 60°C | |
| | | | | | | | 48 | 36 | 34 | 27 |
| | Quenching at 890°C Mid.Temper. at 380°C | C50 | 1860 | 1810 | 13 | 40 | 46 | 34 | 34 | 26 |

Figure 7

General Engineering Universal Steel
Tool Steel

| Alloying Sistem | (Si+Cu)/V | Chemical Composition, wt. % | | | | | | | |
|---|---|---|---|---|---|---|---|---|---|
| | | C | Mn | Si | Cr | Cu | V | S | P |
| | 6.12 | 0.63 | 0.81 | 0.97 | 1.14 | 0.56 | 0.25 | 0.023 | 0.021 |

| Si - Cu - V | Heat Treatment | Static and Dynamic Characteristics | | | | | | | | |
|---|---|---|---|---|---|---|---|---|---|---|
| | | Rockwell Hardness | Tensile Min. Strength, N/sq. mm | Est. Yield Min. Strength, N/sq. mm | Elongation, % | Reduction Area, % | Impact Value, J/sq. cm | | | |
| | | | | | | | KCU | KCV | KCU | KCV |
| | | | | | | | + 20°C | | - 40°C | |
| | Quenching at 860°C Low Temper. at 180°C | C62 | 2450 | 2290 | 6 | 24 | 38 | 16 | 17 | 11 |

| Alloying System | (Ge+Cu)/V | Chemical Composition, wt. % | | | | | | | | |
|---|---|---|---|---|---|---|---|---|---|---|
| | | C | Mn | Si | Cr | Ge | Cu | V | S | P |
| | 5.4 | 0.58 | 0.74 | 0.32 | 1.27 | 0.98 | 0.48 | 0.27 | 0.019 | 0.022 |

| Ge – Cu - V | Heat Treatment | Static and Dynamic Characteristics | | | | | | | | |
|---|---|---|---|---|---|---|---|---|---|---|
| | | Rockwell Hardness | Tensile Min. Strength, N/sq. mm | Est. Yield Min. Strength, N/sq. mm | Elongation, % | Reduction Area, % | Impact Value, J/sq. cm | | | |
| | | | | | | | KCU | KCV | KCU | KCV |
| | | | | | | | + 20°C | | - 40°C | |
| | Quenching at 860°C Low Temper. at 180°C | C60 | 2410 | 2370 | 8 | 32 | 48 | 34 | 32 | 27 |

Figure 8

Stainless Universal Steel
High Ductility Steel

| Alloying System | (Si+Cu)/V | Chemical Composition, wt. % | | | | | | | |
|---|---|---|---|---|---|---|---|---|---|
| | | C | Mn | Si | Cr | Cu | V | S | P |
| | 6.77 | 0.12 | 0.18 | 0.85 | 16.2 | 0.64 | 0.22 | 0.021 | 0.019 |

| Si - Cu - V | Heat Treatment | Static and Dynamic Characteristics | | | | | |
|---|---|---|---|---|---|---|---|
| | | Brinell Hardness | Tensile Min. Strength, N/sq. mm | Est. Yield Min. Strength, N/sq. mm | Elongation, % | Reduction Area, % | Impact Value, KCU, J/sq. cm |
| | Rolling High Tempering | 240 | 670 | 520 | 22 | 60 | 82 |

| Alloying System | (Ge+Cu)/V | Chemical Composition, wt. % | | | | | | | | |
|---|---|---|---|---|---|---|---|---|---|---|
| | | C | Mn | Si | Cr | Ge | Cu | V | S | P |
| | 5.91 | 0.15 | 0.21 | 0.14 | 15.8 | 0.88 | 0.54 | 0.24 | 0.02 | 0.021 |

| Ge - Cu -V | Heat Treatment | Static and Dynamic Characteristics | | | | | |
|---|---|---|---|---|---|---|---|
| | | Brinell Hardness | Tensile Min. Strength, N/sq. mm | Est. Yield Min. Strength, N/sq. mm | Elongation, % | Reduction Area, % | Impact Value, KCU, J/sq. cm |
| | Rolling High Tempering | 260 | 680 | 560 | 24 | 65 | 98 |

Figure 9

Stainless Universal Steel
Direct Hardening Steel

| Alloying System | (Si+Cu)/V | Chemical Composition, wt. % | | | | | | | |
|---|---|---|---|---|---|---|---|---|---|
| | | C | Mn | Si | Cr | Cu | V | S | P |
| | 14.4 | 0.45 | 0.27 | 1.01 | 16.7 | 0.72 | 0.12 | 0.021 | 0.019 |

| Si - Cu - V | Heat Treatment | Static and Dynamic Characteristics | | | | | |
|---|---|---|---|---|---|---|---|
| | | Rockwell Hardness | Tensile Min. Strength, N/sq. mm | Est. Yield Min. Strength, N/sq. mm | Elongation, % | Reduction Area, % | Impact Value, KCU, J/sq. cm |
| | Quenching at 1100°C Low Tempering at 200°C | C59 | 2115 | 1920 | 6 | 15 | 36 |

| Alloying System | (Ge+Cu)/V | Chemical Composition, wt. % | | | | | | | | |
|---|---|---|---|---|---|---|---|---|---|---|
| | | C | Mn | Si | Cr | Ge | Cu | V | S | P |
| | 8.83 | 0.42 | 0.24 | 0.17 | 15.9 | 0.98 | 0.61 | 0.18 | 0.019 | 0.019 |

| Ge – Cu - V | Heat Treatment | Static and Dynamic Characteristics | | | | | |
|---|---|---|---|---|---|---|---|
| | | Rockwell Hardness | Tensile Min. Strength, N/sq. mm | Est. Yield Min. Strength, N/sq. mm | Elongation, % | Reduction in Area, % | Impact Value, KCU, J/sq. cm |
| | Quenching at 1100°C Low Tempering at 200°C | C56 | 2020 | 1890 | 8 | 22 | 54 |

Figure 10

Stainless Universal Steel, Direct Hardening Steel

| Alloying System | (Si+Cu)/V | Chemical Composition, wt. % | | | | | | | |
|---|---|---|---|---|---|---|---|---|---|
| | | C | Mn | Si | Cr | Cu | V | S | P |
| | 14.4 | 0.45 | 0.27 | 1.01 | 16.7 | 0.72 | 0.12 | 0.021 | 0.019 |

| (Si +Cu)/V | Heat Treatment | Corrosion Resistance Characteristics | | |
|---|---|---|---|---|
| | | Agent and Test Conditions | Time of Test, hours | Durability, Index according to GOST 13619-68 |
| | Quenching at 1100°C Low Temper. at 200°C | $H_2SO_4$ (93%), +20°C | 288 | 3 durable enough |
| | | | 600 | 4 durable under activation |
| | | $HNO_3$ (56%), +20°C | 288 | 4 durable |
| | | | 600 | 1 absolutely durable |
| | | Sea Water + 400 ml. $H_2S$, +20°C | 790 | 2 durable enough |
| | | Na Cl (3%), at boiling t°C | 60 | 4 durable |

| Alloying System | (Ge+Cu)/V | Chemical Composition, wt. % | | | | | | | | |
|---|---|---|---|---|---|---|---|---|---|---|
| | | C | Mn | Si | Cr | Ge | Cu | V | S | P |
| | 8.83 | 0.42 | 0.24 | 0.17 | 15.9 | 0.98 | 0.61 | 0.18 | 0.019 | 0.019 |

| (Ge +Cu)/V | Heat Treatment | Corrosion Resistance Characteristics | | |
|---|---|---|---|---|
| | | Agent and Test Conditions | Time of Test, hours | Durability, Index according to GOST 13619-68 |
| | Quenching at 1100°C Low Temper. at 200°C | $H_2SO_4$ (93%), +20°C | 288 | 2 durable enough |
| | | | 600 | 2 durable under activation |
| | | $HNO_3$ (56%), +20°C | 288 | 3 durable |
| | | | 600 | 1 absolutely durable |
| | | Sea Water + 400 ml. $H_2S$, +20°C | 790 | 1 durable enough |
| | | Na Cl (3%), at boiling t°C | 60 | 3-4 durable |

Figure 11

Stainless Universal Steel
Tool Steel

| Alloying System | (Si+Cu)/V | Chemical Composition, wt. % | | | | | | | |
|---|---|---|---|---|---|---|---|---|---|
| | | C | Mn | Si | Cr | Cu | V | S | P |
| | 10.4 | 0.63 | 0.17 | 0.84 | 16.2 | 0.72 | 0.15 | 0.023 | 0.021 |

| Si - Cu - V | Heat Treatment | Static and Dynamic Characteristics | | | | | |
|---|---|---|---|---|---|---|---|
| | | Rockwell Hardness | Tensile Min. Strength, N/sq. mm | Est. Yield Min. Strength, N/sq. mm | Elongation, % | Reduction Area, % | Impact Value, KCU, J/sq. cm |
| | Quenching at 1100°C Low Temper. at 200°C | C61 | 2180 | 1750 | 3 | 11 | 25 |

| Alloying System | (Ge+Cu)/V | Chemical Composition, wt. % | | | | | | | | |
|---|---|---|---|---|---|---|---|---|---|---|
| | | C | Mn | Si | Cr | Ge | Cu | V | S | P |
| | 6.63 | 0.60 | 0.21 | 0.18 | 16.8 | 1.02 | 0.44 | 0.22 | 0.019 | 0.020 |

| Ge - Cu -V | Heat Treatment | Static and Dynamic Characteristics | | | | | |
|---|---|---|---|---|---|---|---|
| | | Rockwell Hardness | Tensile Min. Strength, N/sq. mm | Est. Yield Min. Strength, N/sq. mm | Elongation, % | Reduction Area, % | Impact Value, KCU, J/sq. cm |
| | Quenching at 1100°C Low Temper. at 200°C | C59 | 2150 | 1910 | 7 | 18 | 42 |

Figure 12

General Engineering Universal Steel
Maraging Steel

| Alloying System | (Si+Cu)/V | Chemical Composition, wt. % | | | | | | | |
|---|---|---|---|---|---|---|---|---|---|
| | | C | Ni | Si | Cr | Cu | V | S | P |
| | 2.35 | 0.10 | 8.4 | 0.92 | 11.2 | 0.64 | 0.67 | 0.018 | 0.019 |

| Si - Cu - V | Heat Treatment | Static and Dynamic Characteristics | | | | | | | |
|---|---|---|---|---|---|---|---|---|---|
| | | Rockwell Hardness | Tensile Min. Strength, N/sq. m² | Est. Yield Min. Strength, N/sq. m² | Elongation, % | Reduction Area, % | Impact Value, KCU, J/sq. cm | | |
| | | | | | | | +20°C | - 196°C | - 253°C |
| | Quenching at 980°C Mid. Temper. at 450°C | C44 | 1350 | 1320 | 24 | 72 | 180 | 82 | 54 |

| Alloying System | (Ge+Cu)/V | Chemical Composition, wt. % | | | | | | | | |
|---|---|---|---|---|---|---|---|---|---|---|
| | | C | Ni | Si | Cr | Ge | Cu | V | S | P |
| | 2.11 | 0.09 | 8.6 | 0.17 | 11.8 | 0.84 | 0.58 | 0.65 | 0.018 | 0.018 |

| Ge – Cu - V | Heat Treatment | Static and Dynamic Characteristics | | | | | | | |
|---|---|---|---|---|---|---|---|---|---|
| | | Rockwell Hardness | Tensile Min. Strength, N/sq. mm | Est. Yield Min. Strength, N/sq. mm | Elongation, % | Reduction Area, % | Impact Value, KCU, J/sq. cm | | |
| | | | | | | | +20°C | -196°C | -253°C |
| | Quenching at 980°C Mid. Temper. at 450°C | C44 | 1340 | 1335 | 28 | 79 | 220 | 102 | 61 |

Figure 13

SI(GE)(-) CU(-)V UNIVERSAL ALLOY STEEL

RELATED APPLICATIONS

This is a continuation-in-part of PCT patent application Ser. No. PCT/RU96/00184 filed on Jul. 9, 1996, and PCT patent application Ser. No. PCT/RU96/00230 filed on Aug. 15, 1996.

FIELD OF THE INVENTION

This invention relates to steel alloys, commonly designated as specialty steels, and more particularly to steel alloy systems and methods for improving the mechanical properties of alloy steels, reducing the complexity of alloy steel compositions and reducing costs.

BACKGROUND OF THE INVENTION

The mechanical properties of alloy steels vary with the properties of their free metal boundaries, grain bodies and grain and phase boundaries. Current practices rely on many alloying systems and thermomechanical treatments, such as rolling, pressing, hammering and forging and various chemical and heat treatments to alter the mechanical properties of alloy steels. Current alloying systems are based on the idea of steel microstructure modifications and do not consider the effects of grain boundaries between crystals and alloy phase components on mechanical properties.

Iron (Fe), carbon (C), manganese (Mn), phosphorous (P), sulphur (S), silicon (Si), and traces of oxygen (O), nitrogen (N), and aluminum (Al) are always present in steel, together with alloying elements, such as nickel (Ni), chromium (Cr), copper (Cu), molybdenum (Mo), tungsten (W), cobalt (Co) and vanadium (V). Current alloying systems, steel making and heat treatment practices often produce non-equilibrium segregations of traditionally harmful admixtures (S, P, Sn, etc.) as well as embrittling non-metallic phases on free metal surfaces, grain and phase boundaries during tempering. Chemical heat treatments, such as nitro-carburizing and nitriding cause brittleness and distortion of grain bodies due to formation of a second, large volume phase along grain boundaries, having a harmful effect on the viscous characteristics of steel. For example, the impact strength of steel containing (by weight) 0.25% C; 1.6% Cr; 1.5% Ni; 1.0% W; and 0.6% Mo, is reduced to 2–3 J/cm$^2$, following oil quenching at 980° C. and a 24 hour temper at 500° C. (false nitriding).

Another aspect of current steel alloying, making and heat treatment practices is that increases in strength decrease ductility, and in the alternative, increases in ductility decrease strength. Heretofore, no satisfactory compromise has been found between strength and ductility of alloy steels.

Current practices require large numbers of classes and grades of alloy steels, large investments and large inventories to support the requirements of industrial and consumer products. More than 320 grades of specialty steels are produced in the United States; 70–100 in Germany; 140–160 in Great Britain; 60–70 in Sweden; 140–160 in France; 100–120 in Japan; and 140–150 in Russia.

The following alloying systems are typical of current practices:

A: Structural, heat-treatable, carburizing, nitro-carburizing, and nitriding steels
  1. Fe—C—Cr
  2. Fe—C—Cr—Mo—Al
  3. Fe—C—Cr—Ni—Mo B. Die, spring, maraging, and duplex steels 1. Fe—C—Cr—Si
  2. Fe—C—Cr—Si—V—B
  3. Fe—C—Cr—Si—Ni—Mo—(V, Ti)—N C. High speed tool steels
  1. Fe—C—Cr—W—Mo—V—Co D. High temperature steels
  1. Fe—C—Cr—Ni—Mo—Si—(V, Ti, Nb)

E. Free-cutting steels
  1. Fe—C—Cr—(Ca, Pb, Se, Te, Sb)

Another aspect of the current practice is that vast, complex facilities are required to support the many current alloying systems. Large sums of money are required to establish and maintain large inventories and complex facilities.

SUMMARY OF THE INVENTION

One benefit of the present invention is that strength of steels can be increased without significant reductions in ductility, or in the alternative, ductility can be increased without significant reductions in strength. Another major benefit is that the number of grades of specialty steels for meeting industrial and consumer requirements can be substantially reduced. Another benefit is that number and complexity of steel making facilities can be substantially reduced. Another benefit is that substantial savings can be made in reducing inventories. Another benefit is that various grades of steel can be produced by using a continuous casting furnace, varying the amount of carbon during melting; better commonality can be achieved for all subsequent metallurgical conversion processes (casting, heating, rolling, heat treatment). Still yet another benefit is that use of expensive alloying elements, such as, nickel (Ni), molybdenum (Mo), titanium (Ti), cobalt (Co), boron (B), and tungsten (W) can be eliminated, except for maraging steels.

The invention resides in the ability of certain combinations of carbon-subgroup surfactants and d-transition metals, which will be described in proper sequence, in $\alpha$ and $(\alpha+\gamma)$ steels to: 1) modify and control diffusion mechanisms of interstitial elements; 2) reduce or prevent the formation of non-equilibrium segregations of harmful admixtures and brittle phases being formed on free metal surfaces, grain and phase boundaries; 3) alter and control the phase transformation kinetics in steel during heating and cooling.

In a first embodiment of the invention, combinations of silicon, copper and vanadium comprise the carbon-subgroup surfactants and d-transition metals. In a second aspect of the invention combinations of germanium, copper and vanadium comprise the carbon-subgroup surfactants and d-transition metals.

Further aspects, benefits and features of the invention will become apparent from the ensuing detailed description of the invention. The best mode which is contemplated in practicing the invention together with the manner of using the invention are disclosed and the property in which exclusive rights are claimed is set forth in each of a series of numbered claims at the conclusion of the detailed description.

BRIEF DESCRIPTION OF THE DRAWINGS

The invention will be better understood and further objects, characterizing features, details and advantages thereof will appear more clearly with reference to the drawings illustrating a presently preferred specific embodiment of the invention by way of non-limiting example only.

The tables given below contain specific chemical compositions of steels belonging to different classes, as well as their mechanical and some operational properties after various types of heat treatment (quenching+tempering), carburizing and nitriding.

FIG. 1 is a table of universal steels according to the invention.

FIG. 2 is a table of a pair of high-ductility steels according to the invention.

FIG. 3 is a table of a pair of case hardening steels according to the invention.

FIG. 4 is a table of a direct hardening, nitriding steel according to the invention.

FIG. 5 is a table of another direct hardening, nitriding steel according to the invention.

FIG. 6 is a table of a pair of direct hardening, nitriding steels and their operational properties according to the invention.

FIG. 7 is a table of a pair of direct hardening, nitriding steels according to the invention.

FIG. 8 is a table of a pair of tool steels according to the invention.

FIG. 9 is a table of a pair of corrosion-resistant, high-ductility steels according to the invention.

FIG. 10 is a table of a pair of corrosion-resistant, direct hardening steels according to the invention.

FIG. 11 is a table of a pair of corrosion-resistant direct hardening steels according to the invention, and their corrosion resistance in various aggresive environments.

FIG. 12 is a table of a pair of corrosion-resistant tool steels according to the invention.

FIG. 13 is a table of a pair of maraging steels according to the invention.

DETAILED DESCRIPTION OF THE PREFERRED EMBODIMENT

The present invention is a fundamentally new and universal alloying system and method for improving the mechanical properties of steel, reducing the classes and grades of specialty steels, reducing investment costs, reducing inventory costs, reducing steel making operating costs, as well as the costs of machine-building facilities. The invention was developed after extensive studies of the effect various alloying elements have on the steel structure and properties, taking into account their electron structure, adsorption activity with respect to free metal surfaces, grain and phase boundaries, as well as changes in electron density of solid solutions of the substitutional elements (Al, Si, Cr, V, Ti, Nb, Zr, Mo, W, Co, Ni, Cu, Ge) and interstitial elements (C, N, O, H, S, P) in $\alpha$-iron and $\gamma$-iron.

The essence of the invention is that when certain combinations of small amounts of a complex of carbon-subgroup surfactants, such as silicon and germanium, and d-transition metals, such as copper and vanadium, are added to $\alpha$ or ($\alpha+\gamma$) iron-based alloys, containing 0.08 to 0.65 wt % of carbon; 0.35 to 0.75 wt % manganese; and 0.60 to 18 wt % chromium, the following benefits are obtained:

1. The diffusion of interstitial elements, C, N, O, and H can be modified and controlled.
2. The formation or non-equilibrium segregations of the traditionally harmful admixtures of P, S, Sb, etc. and brittle phases on free metal surfaces, grain, and phase boundaries can be prevented or reduced.
3. The kinetics of phase transformations in steels during heating and cooling can be modified and controlled.

The relationship between the carbon-subgroup surfactants and the d-transition metals which produce the above improvements is as follows:

$$(A+B)/C=k$$

where k stands for a constant, A stands for a carbon-subgroup surfactant, B stands for the d-transition metal copper, and C stands for the d-transition metal vanadium.

In a first embodiment of the invention, A stands for 0.75 to 1.50 wt % of silicon; B stands for 0.40 to 0.80 wt % of copper; and k is within the range of 2 to 14.

In a second embodiment of the invention, A stands for 0.60 to 1.50 wt % of germanium; B stands for 0.40 to 0.80 wt % of copper; and k is within the range of 4 to 11.

For each of the above embodiments, the different classes of universal alloy steels shown in FIG. 1 were developed and studied. The classes are expressed as the points carbon followed by the percentages of other elements. By way of example, the maraging steel in FIG. 1 is comprised of 0.10 percent carbon; 10 percent chromium, 8 percent nickel and the elements A, B, C, as disclosed in the aforedescribed embodiments.

Except for the Ni of the 10Cr10Ni8ABC maraging steel, none of the above steels require the scarce and expensive alloying elements: Mo, Ni, W, Nb, N, B, Co. Moreover, with my invention, different specialty steels, including corrosion-resistant and maraging steels, can be produced by merely adding different amounts of carbon during a continuous casting of ingots and subsequent thermomechanical treatments while maintaining the same amounts of other elements. The following compositions are illustrative of the best mode which is contemplated for practicing my invention, reference being made to FIGS. 1 through 13, for mechanical properties of specimens of said alloy steels:

A. General Engineering Steel

I High Ductility Steel (FIG. 2)

| | | |
|---|---|---|
| a. | Carbon | 0.08–0.18 |
| | Manganese | 0.35–0.75 |
| | Silicon | 0.75–1.50 |
| | Chromium | 0.60–3.00 |
| | Copper | 0.40–0.80 |
| | Vanadium | 0.10–0.35 |
| | Iron | remainder |
| b. | Carbon | 0.08–0.18 |
| | Manganese | 0.35–0.75 |
| | Silicon | 0.35–0.45 |
| | Chromium | 0.60–3.00 |
| | Germanium | 0.60–1.50 |
| | Copper | 0.40–0.60 |
| | Vanadium | 0.10–0.35 |
| | Iron | remainder |

II Case Hardening Steel (FIG. 3)

| | | |
|---|---|---|
| a. | Carbon | 0.18–0.28 |
| | Manganese | 0.35–0.75 |
| | Silicon | 0.75–1.50 |
| | Chromium | 0.60–3.00 |
| | Copper | 0.40–0.80 |
| | Vanadium | 0.10–0.35 |
| | Iron | remainder |
| b. | Carbon | 0.18–0.28 |
| | Manganese | 0.35–0.75 |
| | Silicon | 0.35–0.45 |
| | Chromium | 0.60–3.00 |
| | Germanium | 0.60–1.50 |

-continued

| | |
|---|---|
| Copper | 0.40–0.80 |
| Vanadium | 0.10–0.35 |
| Iron | remainder |

III Direct Hardening, Nitriding Steel (FIGS. 4–6)

| | |
|---|---|
| a. Carbon | 0.28–0.45 |
| Manganese | 0.35–0.75 |
| Silicon | 0.75–1.50 |
| Chromium | 1.60–3.00 |
| Copper | 0.40–0.80 |
| Vanadium | 0.10–0.35 |
| Iron | remainder |
| b. Carbon | 0.28–0.45 |
| Manganese | 0.35–0.75 |
| Silicon | 0.35–0.45 |
| Chromium | 1.60–3.00 |
| Germanium | 0.60–1.50 |
| Copper | 0.40–0.80 |
| Vanadium | 0.10–0.35 |
| Iron | remainder |

IV Direct Hardening, Nitriding Steel (FIG. 7)

| | |
|---|---|
| a. Carbon | 0.45–0.55 |
| Manganese | 0.35–0.75 |
| Silicon | 0.75–1.50 |
| Chromium | 0.60–3.00 |
| Copper | 0.40–0.80 |
| Vanadium | 0.10–0.35 |
| Iron | remainder |
| b. Carbon | 0.45–0.55 |
| Manganese | 0.35–0.75 |
| Silicon | 0.35–0.45 |
| Chromium | 0.60–3.00 |
| Germanium | 0.60–1.50 |
| Copper | 0.40–0.80 |
| Vanadium | 0.10–0.35 |
| Iron | remainder |

V Tool Steel (FIG. 8)

| | |
|---|---|
| a. Carbon | 0.55–0.65 |
| Manganese | 0.35–0.75 |
| Silicon | 0.75–1.50 |
| Chromium | 0.60–3.00 |
| Copper | 0.40–0.80 |
| Vanadium | 0.10–0.35 |
| Iron | remainder |
| b. Carbon | 0.55–0.65 |
| Manganese | 0.35–0.75 |
| Silicon | 0.35–0.45 |
| Chromium | 0.60–3.00 |
| Germanium | 0.60–1.50 |
| Copper | 0.40–0.80 |
| Vanadium | 0.10–0.35 |
| Iron | remainder |

B. Stainless Steel (FIG. 13)
VI Maraging Steel

| | |
|---|---|
| a. Carbon | 0.05–0.22 |
| Chromium | 9.50–12.50 |
| Nickel | 3.50–8.50 |

-continued

| | |
|---|---|
| Silicon | 0.75–1.50 |
| Copper | 0.40–0.80 |
| Vanadium | 0.10–1.00 |
| Iron | remainder |
| b. Carbon | 0.05–0.22 |
| Chromium | 9.50–12.50 |
| Nickel | 3.50–8.60 |
| Germanium | 0.60–1.50 |
| Copper | 0.40–0.80 |
| Vanadium | 0.10–1.00 |
| Iron | remainder |

VII High Ductility Steel (FIG. 9)

| | |
|---|---|
| a. Carbon | 0.08–0.28 |
| Manganese | 0.35–0.75 |
| Silicon | 0.75–1.50 |
| Chromium | 12.5–18.00 |
| Copper | 0.40–0.80 |
| Vanadium | 0.10–0.35 |
| Iron | remainder |
| b. Carbon | 0.08–0.28 |
| Manganese | 0.35–0.75 |
| Silicon | 0.35–0.45 |
| Chromium | 12.5–18.00 |
| Germanium | 0.60–1.50 |
| Copper | 0.40–0.80 |
| Vanadium | 0.10–0.35 |
| Iron | remainder |

VIII Direct Hardening Steel (FIGS. 10 and 11)

| | |
|---|---|
| a. Carbon | 0.28–0.56 |
| Manganese | 0.35–0.75 |
| Silicon | 0.75–1.50 |
| Chromium | 12.5–18.00 |
| Copper | 0.40–0.80 |
| Vanadium | 0.15–0.35 |
| Iron | remainder |
| b. Carbon | 0.28–0.56 |
| Manganese | 0.35–0.75 |
| Silicon | 0.35–0.45 |
| Chromium | 12.5–18.00 |
| Germanium | 0.60–1.50 |
| Copper | 0.40–0.80 |
| Vanadium | 0.10–0.35 |
| Iron | remainder |

IX Tool Steel (FIG. 12)

| | |
|---|---|
| a. Carbon | 0.56–0.65 |
| Manganese | 0.35–0.75 |
| Silicon | 0.75–1.50 |
| Chromium | 12.5–18.00 |
| Copper | 0.40–0.80 |
| Vanadium | 0.10–0.35 |
| Iron | remainder |
| b. Carbon | 0.56–0.065 |
| Manganese | 0.35–0.75 |
| Silicon | 0.35–0.45 |
| Chromium | 12.5–18.00 |
| Germanium | 0.60–1.50 |
| Copper | 0.40–0.80 |
| Vanadium | 0.10–0.35 |
| Iron | remainder |

From the foregoing, it will be understood that my universal alloy steel is a fundamentally new composition and method which provides substantial benefits over current practices. In addition to improving the mechanical properties of steel, it reduces complexity and the costs of establishing and maintaining large inventories and facilities.

Although only several embodiments of my invention have been described, it will be appreciated that other embodiments can be developed by changes, such as substitution and addition of elements, and changes in the amounts of an element, without departing from the spirit thereof.

I claim:

1. An alloy steel composition comprising by weight percent: 0.60–1.50% germanium; 0.40–0.80% copper; 0.10–0.35% vanadium; and the remainder, iron, manganese, silicon, chromium, carbon and incidental impurities.

2. (Reproduced anew as submitted in the Response (Paper No. 17) to the Final Office action) A general purpose construction carburizing or nitriding steel composition comprising by weight percent: 0.75–1.50% of silicon; 0.40–0.80% of copper; 0.10–0.35 of vanadium; 0.35–0.75% of manganese; 0.60–3.0% of chromium; 0.08 to less than 0.30% of carbon; iron and the remainder incidental impurities, whereby improved mechanical properties, reduced complexity, and reduced costs of steel compositions are attained.

* * * * *